US012428851B2

(12) United States Patent
Tuckey

(10) Patent No.: US 12,428,851 B2
(45) Date of Patent: Sep. 30, 2025

(54) TELESCOPIC HAND RAIL

(71) Applicant: Home Safe Products Ltd, Hilsea (GB)

(72) Inventor: Tony J. Tuckey, Hilsea (GB)

(73) Assignee: HOME SAFE PRODUCTS LTD, Hilsea (GB)

( * ) Notice: Subject to any disclaimer, the term of this patent is extended or adjusted under 35 U.S.C. 154(b) by 381 days.

(21) Appl. No.: 17/977,544

(22) Filed: Oct. 31, 2022

(65) Prior Publication Data

US 2024/0141651 A1 May 2, 2024

(51) Int. Cl.
*E04F 11/18* (2006.01)

(52) U.S. Cl.
CPC ..... *E04F 11/1804* (2013.01); *E04F 11/1808* (2013.01); *E04F 2011/187* (2013.01)

(58) Field of Classification Search
CPC ... E04F 11/18; E04F 11/1802; E04F 11/1804; E04F 11/1808; E04F 2011/1868; E04F 2011/187; F16B 7/10; F16B 7/105; E01F 13/024; E04G 5/142
See application file for complete search history.

(56) References Cited

U.S. PATENT DOCUMENTS 1,903,353 A * 4/1933 Wingard ..... B65H 75/30 285/314
3,822,051 A * 7/1974 Karapita ..... F16B 7/10 403/81
4,062,156 A * 12/1977 Roth ..... F16B 7/105 343/903
5,076,547 A * 12/1991 Osterholm ..... E04F 11/18 52/150
5,660,495 A * 8/1997 Atsukawa ..... F16B 7/10 403/374.1
7,185,868 B2 * 3/2007 Wang ..... F16M 11/18 248/161
7,225,694 B2 * 6/2007 Said ..... F16H 25/20 74/89.37
9,896,848 B1 * 2/2018 Tontz ..... E04F 11/1865
9,909,271 B2 * 3/2018 Wiegel ..... E01F 15/003
2003/0001066 A1 * 1/2003 Chen ..... F16B 7/105 248/539

(Continued)

FOREIGN PATENT DOCUMENTS

DE 2318993 A1 * 10/1974
DE 102007009103 B3 * 3/2008 ..... E04F 11/18

(Continued)

*Primary Examiner* — Jonathan P Masinick
(74) *Attorney, Agent, or Firm* — Ronald M. Kachmarik; Cooper Legal Group LLC

(57) ABSTRACT

A telescopic handrail that includes first and second telescoping members adapted to move from a first contracted position to a second expanded position. The telescoping members each having a free end and an opposing telescoping end. The handrail includes locking arrangement to releasably secure the telescoping members in the first contracted position. The handrail includes restraining arrangement to prevent the telescoping members from separating more than the second expanded position. The handrail includes a first fixing device to secure a free end of the first telescoping member to a fixed point. The handrail includes a second releasable fixing device to releasably secure a free end of the second telescoping member to a fixed point.

8 Claims, 3 Drawing Sheets

(56) References Cited

U.S. PATENT DOCUMENTS

| | | | | |
|---|---|---|---|---|
| 2006/0091277 | A1* | 5/2006 | Wang | A47G 33/06<br>248/405 |
| 2019/0352920 | A1* | 11/2019 | Salyer | E04G 5/007 |
| 2023/0096229 | A1* | 3/2023 | Gil | B25J 1/04<br>403/109.1 |

FOREIGN PATENT DOCUMENTS

| | | | | |
|---|---|---|---|---|
| EP | 0192094 | A1 * | 8/1986 | |
| GB | 2461383 | A * | 1/2010 | E04F 11/1804 |
| JP | 2005113580 | A | 4/2005 | |
| KR | 20110107272 | A * | 9/2011 | |
| KR | 101143355 | B1 * | 5/2012 | |

* cited by examiner

TELESCOPIC HAND RAIL

BACKGROUND

The present invention relates to a telescopic handrail.

Many people such as the elderly and infirm find it difficult to walk around the house and often fall over leading to injuries and even fatalities. A common hazard is when ascending or depending a staircase, where a person can fall after leaving the staircase bannister at the top of the stairs as there nothing to hold onto on a landing, or when approaching the staircase from a landing before a person's hand is able to reach the bannister.

SUMMARY

The invention seeks to provide and adjustable length telescopic hand rail which can be positioned strategically in a building to give a person stability when walking around the budding.

According to the present invention them is provided a telescopic handrail comprising:

a) first and second telescoping members adapted to move from a first contracted position to a second expanded position, said telescoping members each having a free end and an opposing telescoping end, b) locking means to releasably secure the telescoping members in the first contracted position, c) restraining means to prevent the telescoping members from separating more than the second expanded position, d) a first fixing device to secure a free end of the first telescoping member to a fixed point, and e) a second releasable fixing device to releasably secure a free end of the second telescoping member to a fixed point.

Preferably the telescoping members can freely slide without restrain relative to each other between the first and second positions.

Preferably the first fixing device allows movement of the telescoping members in two planes relative to the first fixing device. Preferably the first fixing device is connected to first telescoping member through a universal joint.

Preferably the second fixing device has a remote member to secure to a structure and engagement member on the free end of second telescoping member to releasably engage with the remote member. Preferably the remote member has an aperture to releasably receive a pin on the engagement member.

Preferably the locking means includes a magnet to releasably hold the first and second telescoping members in the first contract position.

Preferably the restraining means is a shaft fixed at one end to the free end of one telescoping member and which shaft slides through an aperture in the telescoping end of the other telescoping member, said shaft at its other end having a stop to prevent the aperture in the telescoping end of the other telescoping member sliding of the end of the shaft.

BRIEF DESCRIPTION OF THE DRAWINGS

An embodiment of the invention will now be described with reference to the accompanying drawings in which.

DETAILED DESCRIPTION

Figure 1A:
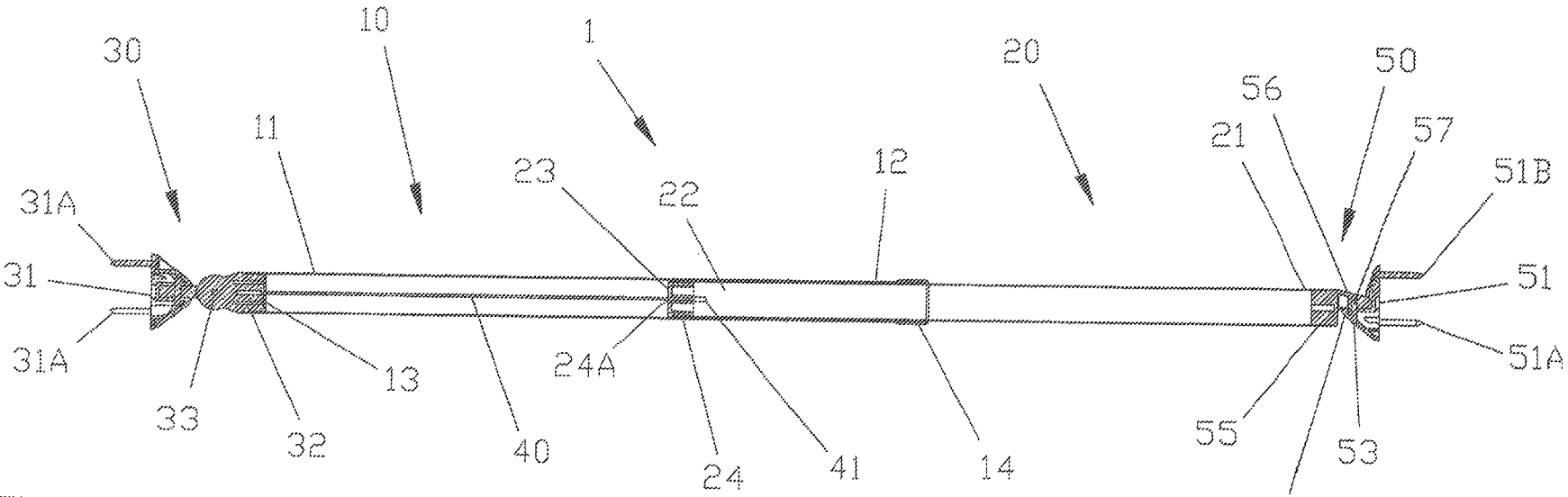
FIGS. 1A and 1B show a cross section view of a handrail in the first contracted and second expanded positions.

Referring to the drawings there is shown a telescopic handrail 1.

Figure 1B:
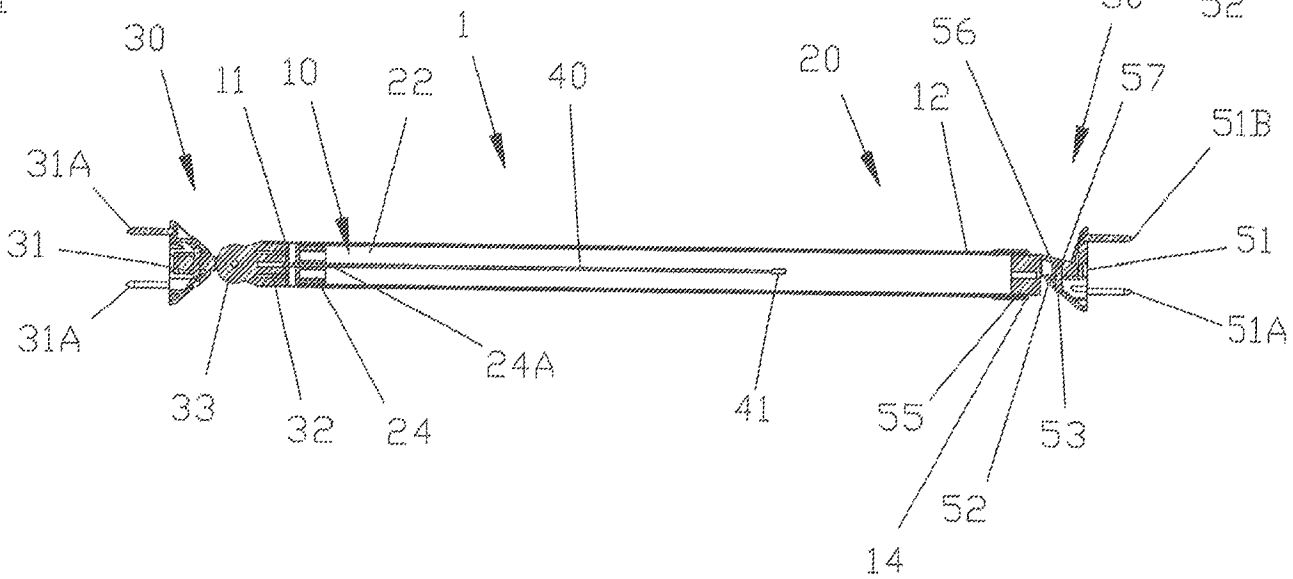
Figure 2A:
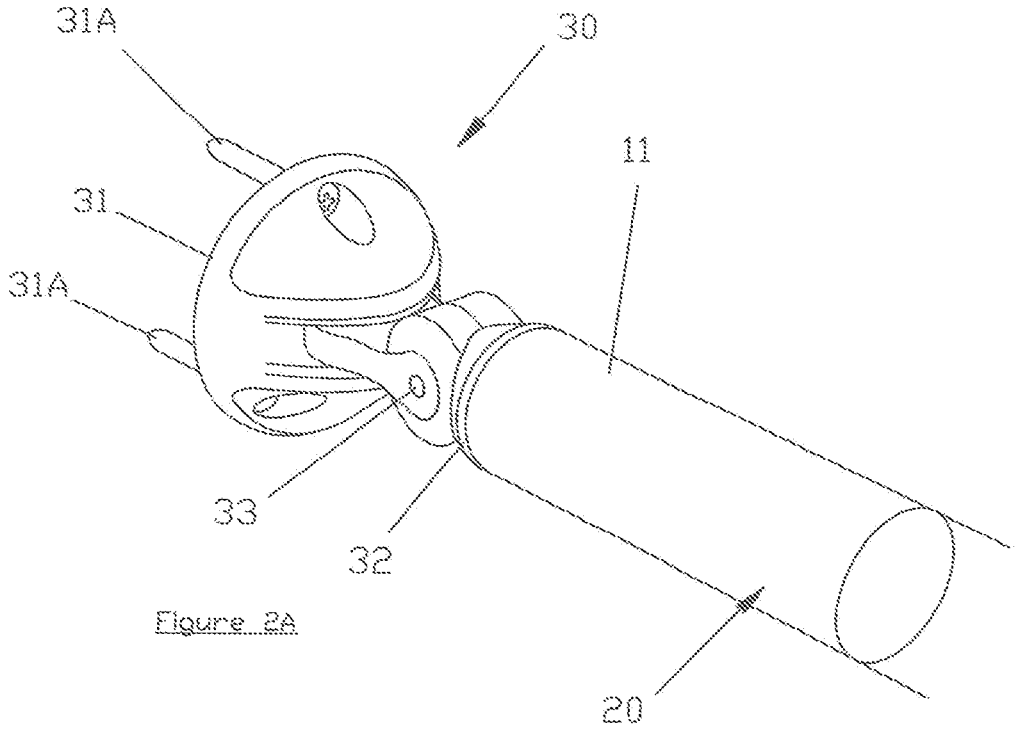
FIGS. 2A and 2B show perspective views of the first fixing device and second fixing device.
Figure 2B:
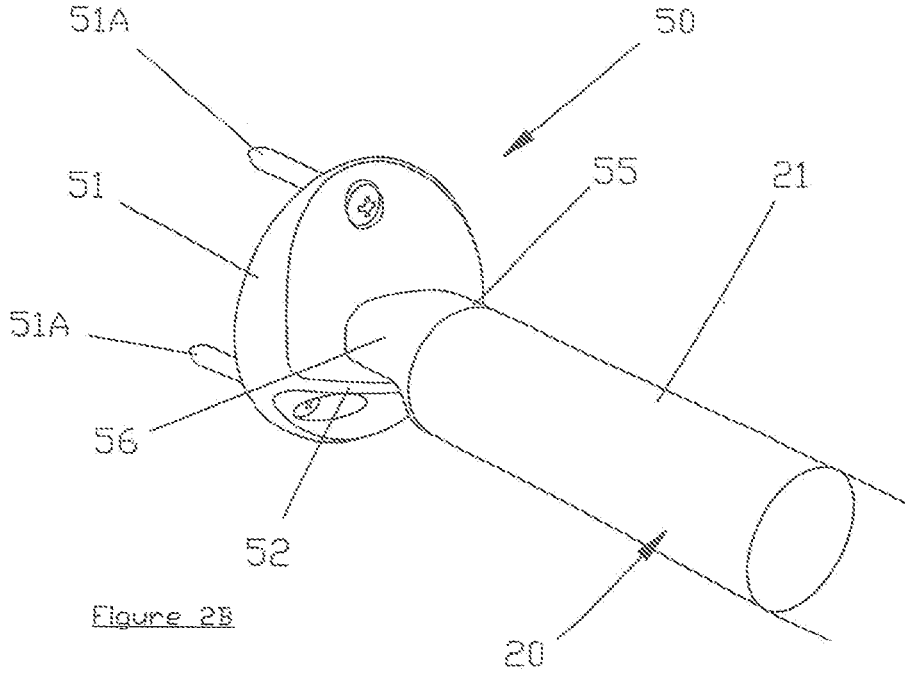

Handrail 1 has first and second telescoping members in the form of telescopic steel cylindrical tubes 10, 20 adapted to move from a first contracted position (see FIG. 1B) to a second expanded position (see FIG. 1A). Each tube has a free end 11, 21 and an opposing telescoping end 12, 22.

A locking means is provided to releasably secure the telescoping members in the first contracted position. The locking means is in the form of a magnet 21 on an end cap 24 at the telescoping end 22 of tube 20, and a metal plate 13 attracted to magnet 23 on a first fixing device 30 at the free end 11 of tube 10. The magnet and plate releasably hold the first and second telescoping members in the first contracted position, but the force of the magnet can be overridden by manually pulling the second tube 20 out of the first tube 10.

A sleeve 14 in the end 12 of tube 10 provides a bearing surface between the tubes 10, 20.

Restraining means is provided to prevent the telescoping members from separating more than the second expanded position. The restraining means is in the form of a shaft 40 (or wire) fixed at one end to first fixing device 30 at the free end 11 of tube 10. Shaft 40 slides through an aperture 24A in the end cap 24 of tube 20, and shaft 44, 11 has a stop 41 to prevent the aperture 24A in end cap 24 sliding off the end of the shaft 40 and limiting withdrawal of the second tube from the first tube to define the second contracted position.

The telescoping members can freely slide without restrain relative to each other between the first and second positions.

First fixing device 30 has a wall plate 31, with wall fixings 31A, connected to a tube cap 32 by means of a universal joint 33. First fixing device 30 can be used to secure a free end 11 of tube 10 to a fixed point, such as the wall at the top of some stairs (see FIG. 3 described below). The first fixing device joint 33 allows movement of the telescoping members in two planes relative to the first fixing device wall plate 31.

A second releasable fixing device 50 is provided to releasably secure a free end 21 of the tube 20 to a fixed point, such as a wall opposing a staircase (see FIG. 3 again). Fixing device 50 has a wall plate 51, with wall fixings 51A and a projection 32 with a pin aperture 53. Device 50 has a separate tube cap 55 with a projection 56 carrying a pin 57, Pin 57 can be inserted in aperture 53 to secure the wall plate 51 to tithe cap 55 and so secure the free end 21 of tube 20 to a wall or other fixed point. As an alternative, a separate pin could be passed through an aperture in the wall plate and tube cap to lock the wall plate and tube cap together.

Figure 3:
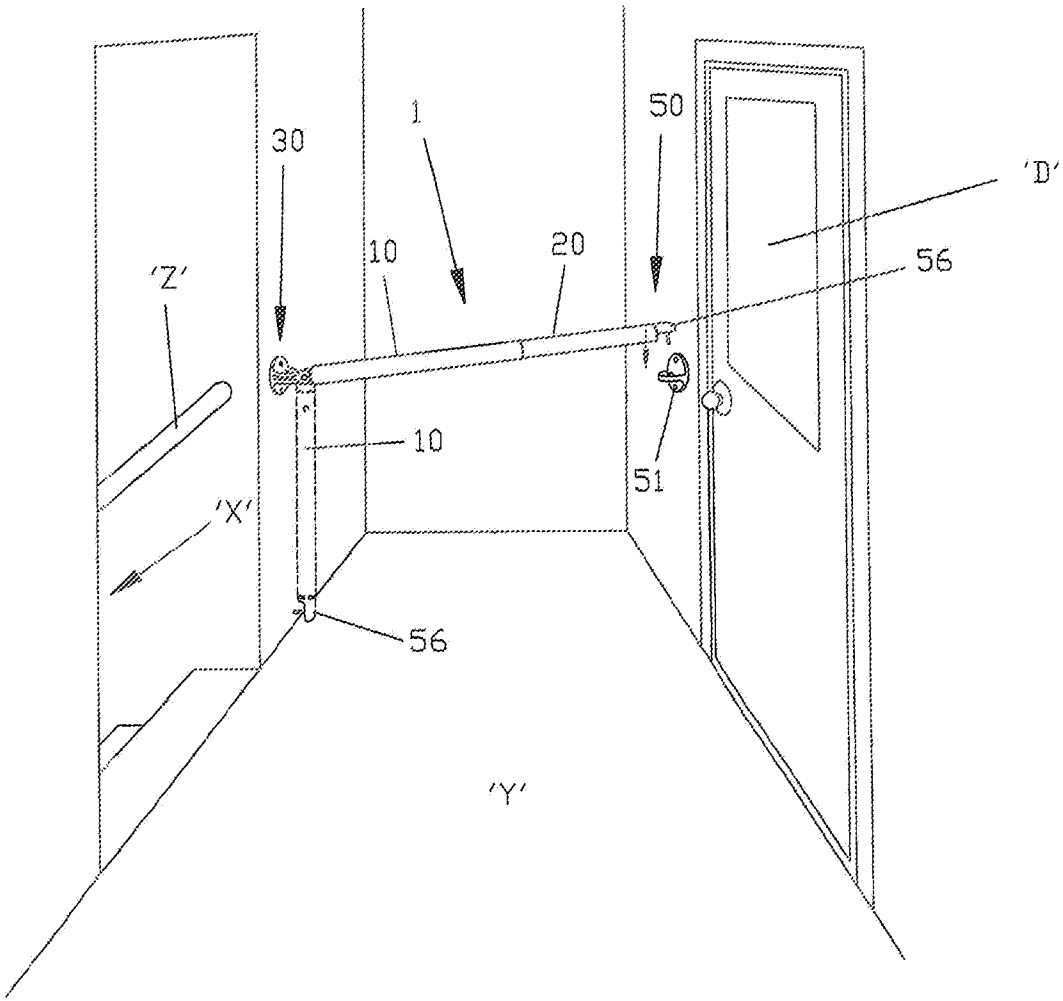
FIG. 3 shows the handrail in use.

Referring to FIG. 3, there is shown a landing Y at the top of stairs X with bannister Z, and a door D opposite the top of the stairs.

When not in use, handrail 10 is secured by first fixing device 30 to the wall adjacent the top of stairs X. Handrail 10 is stored in the first contacted position and dangles vertically downwards off the wall plate 31. In this position it does not interfere physically or visually with itorrn.al use of the stairs and landing.

When in use, the handrail can be extended to the second expanded position and the pin 57 can be inserted into aperture 53 on wall plate 51 mounted on an opposing wall adjacent door D. in this position handrail can be used by a person going up the stairs and needing a handrail from the stairs X to the door D.

The handrail of the invention can be used in many locations as required in a building.

One or more telescoping members could have glow in the dark paint or fluorescent paint or stickers. Also glow in the dark paint or fluorescent paint or sticker/s could be placed adjacent the aperture 53 to help locate pin 57 into the aperture 53 when it is dark.

The invention may take a form different to that specifically described above.

Further modifications will be apparent to those skilled in the art without departing form the scope of the present invention.

The invention claimed is:

1. A telescopic handrail comprising:

a) first and second telescoping members adapted to move from a first contracted position to a second expanded position, said telescoping members each having a free end and an opposing telescoping end, b) locking means to releasably secure the telescoping members in the first contracted position, c) restraining means to prevent the telescoping members from separating more than the second expanded position, d) a first fixing device to secure a free end of the first telescoping member to a fixed point, and e) a second releasable fixing device to releasably secure a free end of the second telescoping member to a fixed point.

2. A telescopic handrail according to claim 1, wherein the telescoping members can freely slide without restrain relative to each other between the first and second positions.

3. A telescopic handrail according to claim 1, wherein the first fixing device allows movement of the telescoping members in two planes relative to the first fixing device.

4. A telescopic handrail according to claim 3, wherein the first fixing device is connected to first telescoping member through a universal joint.

5. A telescopic handrail according to claim 1, wherein the second fixing device has a remote member to secure to a structure and an engagement member on the free end of second telescoping member to releasably engage with the remote member.

6. A telescopic handrail according to claim 5, wherein the remote member has an aperture to releasably receive a pin on the engagement member.

7. A telescopic handrail according to claim 1, wherein the locking means includes a magnet to releasably hold the first and second telescoping members in the first contracted position.

8. A telescopic handrail according to claim 1, wherein the restraining means is a shaft fixed at one end to the free end of one telescoping member and which shaft slides through an aperture in the telescoping end of the other telescoping member, said shaft at its other end having a stop to prevent the aperture in the telescoping end of the other telescoping member sliding off the end of the shaft.

* * * * *